US010925418B2

(12) United States Patent
Reuben

(10) Patent No.: US 10,925,418 B2
(45) Date of Patent: Feb. 23, 2021

(54) DOWN-FILL PILLOW CONSTRUCTION

(71) Applicant: Ronie Reuben, Mont-Royal (CA)

(72) Inventor: Ronie Reuben, Mont-Royal (CA)

( * ) Notice: Subject to any disclaimer, the term of this patent is extended or adjusted under 35 U.S.C. 154(b) by 102 days.

(21) Appl. No.: 16/061,107

(22) PCT Filed: Dec. 9, 2016

(86) PCT No.: PCT/IB2016/057514
§ 371 (c)(1),
(2) Date: Jun. 11, 2018

(87) PCT Pub. No.: WO2017/098478
PCT Pub. Date: Jun. 15, 2017

(65) Prior Publication Data

US 2018/0362329 A1 Dec. 20, 2018

(30) Foreign Application Priority Data

Dec. 11, 2015 (CA) ..... 2914878

(51) Int. Cl.
*A47G 9/10* (2006.01)
*B68G 1/00* (2006.01)
*B68G 3/08* (2006.01)

(52) U.S. Cl.
CPC ..... *A47G 9/10* (2013.01); *A47G 9/1081* (2013.01); *B68G 1/00* (2013.01); *B68G 3/08* (2013.01); *A47G 2009/1018* (2013.01); *B68G 2001/005* (2013.01)

(58) Field of Classification Search
CPC ..... A47G 9/10; A47G 9/1072; A47G 9/1081; A47G 2009/1018; B68G 1/00; B68G 3/08; B68G 2001/005
See application file for complete search history.

(56) References Cited

U.S. PATENT DOCUMENTS 1,312,886 A 8/1919 Bawden
3,148,389 A * 9/1964 Lustig ..... A47C 27/15 5/645

(Continued)

FOREIGN PATENT DOCUMENTS

CA 2269195 A1 10/1999
CN 201767605 U 3/2011

(Continued)

OTHER PUBLICATIONS

English Abstract for CN102462281 retrieved on Espacenet on Aug. 26, 2019.

(Continued)

*Primary Examiner* — David R Hare
(74) *Attorney, Agent, or Firm* — BCF LLP

(57) ABSTRACT

A down-fill pillow structure is formed by a fabric pouch in which is captively retained in close fit therein, one or more down feather sheet of predetermined density and substantially even thickness in which the down feathers are bound together by a binding agent. The down feather sheet has a memory which exhibits rebounding properties. A shaped core body may be inserted in the fabric pouch and encapsulated by the down feather sheet or sheet portions. The down-fill pillow may also be constructed as an ergonomic or non-allergenic pillow.

18 Claims, 3 Drawing Sheets

(56) References Cited

U.S. PATENT DOCUMENTS 3,395,066 A * 7/1968 Tucker ..... D04H 1/42 428/175
3,900,648 A * 8/1975 Smith ..... B32B 5/30 5/636
4,432,110 A * 2/1984 Sutton ..... A47C 7/18 297/DIG. 1
4,606,088 A * 8/1986 Michaelsen ..... A47C 27/22 428/71
4,777,855 A * 10/1988 Cohen ..... A47G 9/10 5/636
4,959,880 A * 10/1990 Tesch ..... A47G 9/10 5/636
5,557,816 A * 9/1996 Pedersen ..... A47G 9/0207 112/475.08
5,689,844 A * 11/1997 Liu ..... A47G 9/10 5/636
6,025,041 A * 2/2000 Reuben ..... A47G 9/0207 428/15
6,232,249 B1 * 5/2001 Kawada ..... A47G 9/007 428/332
6,988,286 B2 1/2006 Schecter et al.
7,461,424 B2 * 12/2008 Lindell ..... A47G 9/10 428/304.4
9,462,902 B1 * 10/2016 Rukel ..... A47G 9/10
2005/0076442 A1 * 4/2005 Wassilefky ..... A47G 9/10 5/636
2005/0278852 A1 * 12/2005 Wahrmund ..... A47G 9/1081 5/636
2007/0245493 A1 * 10/2007 Leifermann ..... A47G 9/0253 5/636
2008/0044619 A1 * 2/2008 Rochlin ..... B68G 1/00 428/80
2013/0263377 A1 * 10/2013 Wootten, Jr. ..... A47C 27/22 5/640
2014/0206796 A1 * 7/2014 Allampalayam Jayaraman ..... D06M 10/025 523/207
2016/0135624 A1 * 5/2016 Heidtmann ..... B68G 1/00 5/638
2017/0042350 A1 * 2/2017 Mittal ..... A47G 9/10
2019/0075948 A1 * 3/2019 Reuben ..... A47G 9/04

FOREIGN PATENT DOCUMENTS

| | | | |
|---|---|---|---|
| CN | 202014936 | U | 10/2011 |
| CN | 102462281 | A | 5/2012 |
| CN | 202234370 | U | 5/2012 |
| CN | 203407816 | U | 1/2014 |
| CN | 203564009 | U | 4/2014 |
| CN | 104995446 | A | 10/2015 |
| FR | 2662066 | A1 | 11/1991 |
| JP | 3134980 | U | 8/2007 |
| JP | 3154028 | U | 10/2009 |
| WO | WO2006/009974 | A1 | 1/2006 |
| WO | WO2015/015214 | A1 | 2/2015 |

OTHER PUBLICATIONS

English Abstract for CN104995446 retrieved on Espacenet on Aug. 26, 2019.
English Abstract for CN203407816 retrieved on Espacenet on Aug. 26, 2019.
Supplementary European Search Report of EP16872533.1; dated Jun. 27, 2019; The Hague; Leo Beugeling.
English Abstract of FR2662066; Retrieved on Jul. 11, 2019; Retrieved from www.worldwide.espacenet.com.
International Search Report with regard to PCT/IB2016/057514 dated Feb. 14, 2017.
English Translation for CN202014936 received from ISA/CA.
English Translation for JP3134980 received from ISA/CA.
English Translation for JP3154028 received from ISA/CA.
English Translation for CN203564009 received from ISA/CA.
English Translation for CN202234370 received from ISA/CA.
English Translation for CN201767605 received from ISA/CA.

* cited by examiner

DOWN-FILL PILLOW CONSTRUCTION

TECHNICAL FIELD

The present invention relates to pillow structures and particularly to down-fill pillow structures.

BACKGROUND OF THE INVENTION

Pillow pouches are manufactured in various constructions including polyurethane foams, polyether fill, feathers, down, and hard or soft core structures whereby to provide support to a user's head and neck during bedtime. Therapeutic pillows are also known but these use materials to provide firm support to the head and neck of the user person. Non-allergenic pillow structures utilize materials which are non-allergenic.

Several problems exist with feather or down fill pillows while these provide comfort in softness and warmth which are desirable features of such pillows. One major problem is the unstability of the feathers or down disposed inside the pillow pouch wherein the feathers or down is unstable and has a tendency to migrate and clump in various areas of the pillow pouch when in use or manipulated in an attempt to obtain a more even distribution of the down inside the pouch. In others words, the feathers or down does not exhibit a constant density throughout the pillow pouch and there is therefore a constant need to shake the pillow case and tamp it with the hand to try and maintain a more constant distribution of the feathers or down inside the pouch. This can become annoying to the user person.

Another problem with feather or down pillows is that the small feathers or down can escape from its pouch and pillow case, particularly during manipulation, tamping and cleaning, and inhaled by the user person. If the person is allergic to feathers, then one has to revert to the use of pillows having non-allergic fill material which do not have the comfort and warmth equivalent to feather or down filled pillows. Feathers and down are unstable products and in the fabrication of pillows the pouches are often filled by hand or blown into the pouch. Such manufacturing methods can be hazardous to the health of the factory workers and does not ensure a constant volume of feathers or down being inserted into the pouch. Still further, the use of down is expensive although it is known to be one of the best insulating products while exhibiting softness to a user's face when sleeping and is capable of restoring its shape after having been compressed during use.

SUMMARY OF THE INVENTION

It is a feature of the present invention to overcome the above mentioned disadvantages of the use of down feathers in the fabrication of down-fill pillows.

Another feature of the present invention is to provide a down-fill pillow construction wherein the down is substantially evenly distributed throughout, inside the pouch of the pillow and remains so during use.

A further feature of the present invention is to provide a down-fill pillow construction wherein the down inside the pouch is prevented from seeping out of the pouch during use or cleaning.

A still further feature of the present invention is to provide a down-fill pillow construction which is simple in construction and wherein down feather sheets of different thicknesses can be used in its construction to provide pillows of different softness or firmness.

Another feature of the present invention is to provide a down-fill pillow construction which utilizes a core body surrounded by down material of substantially even thickness and retained captive about the core body.

A still further feature of the present invention is to provide a down-fill pillow construction wherein the pouch is formed by a pair of down sheets each having a pouch outer fabric material sheet and sewn peripherally together to form a pouch having an open end to receive a core body therein.

Another feature of the present invention is to provide a down-fill pillow construction which is economical to construct and which is less hazardous to the health of the factory workers.

According to the above features, from a broad aspect, the present invention provides a down-fill pillow which is comprised of a fabric pouch in which is captively retained in close fit therein one or more down feather sheet of predetermined density and of substantially even thickness and wherein the down feathers in the sheet are bound together throughout by a binding agent. The down feather sheet has a memory which exhibits rebounding properties.

From a further broad aspect of the present invention a shaped core body is retained in the fabric pouch and encapsulated by the down feather sheet(s).

DESCRIPTION OF THE DRAWINGS

A preferred embodiment of the present invention will now be described with reference to the accompanying drawings in which.

DETAILED DESCRIPTION

Figure 1:
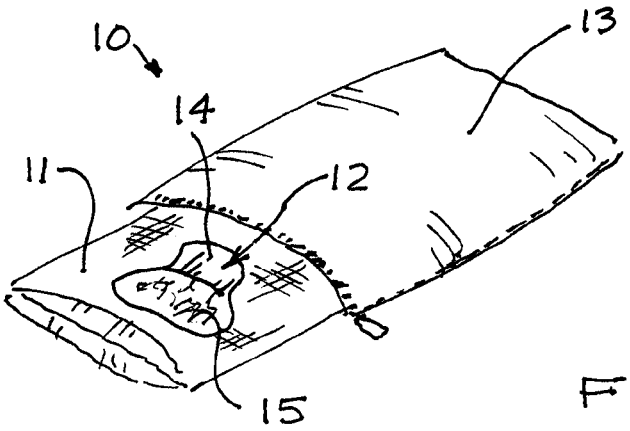
FIG. 1 is a perspective view illustrating a down-fill pillow pouch constructed in accordance with the present invention and being inserted inside a detachable pillow case.
Figure 2:
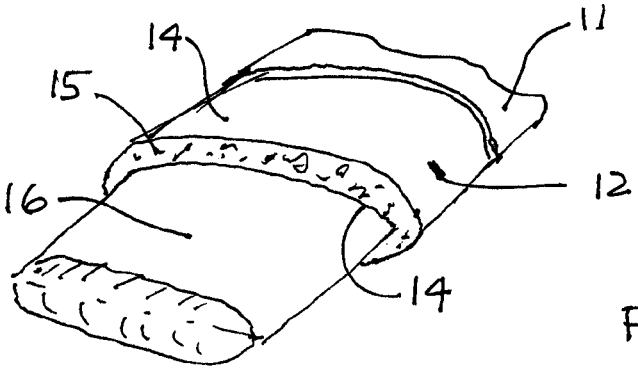
FIG. 2 is a perspective view of the down-fill pillow pouch of the present invention illustrating the internal construction of the pouch which is removably retained inside a pillow case.

Referring now to the drawings and more particularly to FIG. 1 there is shown, generally at 10, the down-fill pillow of the present invention. It comprises a fabric pouch 11 in which there is retained, in close fit therein, one or more down feather sheet 12. As herein illustrated the pouch is being inserted in a pillow case 13. The down feather sheet 12 has a bed of down feathers 15 of substantially constant thickness when positioned within the pouch 12 and the bed of down feathers is held in a substantially homogeneous state by being bound together by a binding agent which can be binding fibers or powder glue activated by heat treatment. As shown, the down feather sheet is in the form of a mat having opposed surface sheets 14 formed of light weight fabric or synthetic material which may have stretchable or binding properties. The bed of down feather feathers 15 exhibits form restoring properties after having been compressed whereby they assume their original form and thickness. Concerning the construction and features of down feather sheets, reference is made to U.S. Pat. No. 6,025,041 entitled "Down Feather Sheet" and PCT International Patent Application PCT/CA 2014/00084 entitled "Thermally Insulated Stretchable Down Feather Sheet and Method of Fabrication".

Figure 3:
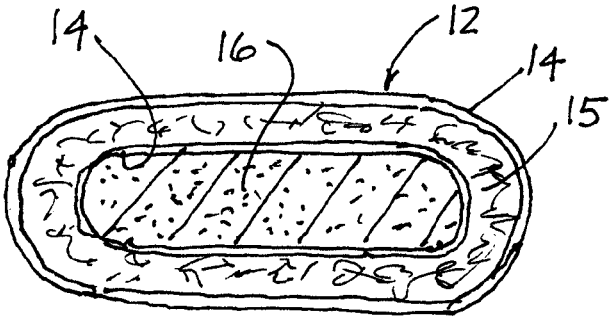
FIG. 3 is a transverse cross-sectional view of the down-fill pillow pouch having a core body encapsulated therein by a down feather sheet(s)

As shown in FIGS. 1 and 3, a shaped core body 16 formed of a compressible foam material may be encapsulated by the down feather sheet 12 surrounding the core body 16. The down feather sheet 12 encapsulating the core body 16 may be formed in sections and may be adhesively retained on the core body. The core body 16 is fabricated from materials, such as polyurethane foam, synthetic or natural rubber foams or combinations thereof, high-resisting polyurethane, or any other suitable material which also has shape restoring properties. The core body 16 is shaped in the form of a pillow but may have different shapes as will be described later. The core body 16 may also be formed from a high density mixture of down and feathers bound together in a block form by a Chemical binding agent and encapsulated by the down feather sheet 12 or opposed sheets thereof bonded on opposed sides of such core body. The use of the core body 16 is to provide a down-fill pillow pouch of reduced cost as down feathers are more expensive than the core materials mentioned above or a mixture of down and feathers.

Figure 4:
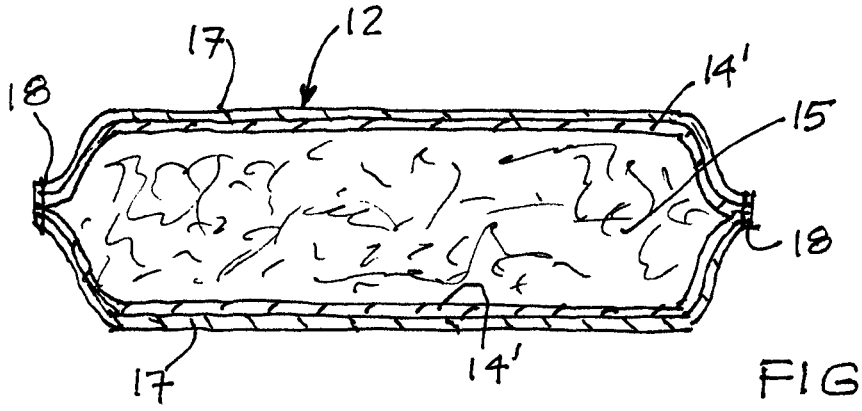
FIG. 4 is a transverse cross-sectional view of a down-fill pillow pouch filled entirely by a thick, high density, down feather sheet.

FIG. 4 illustrates another embodiment where the pouch 12 is formed from a thick bed 15' of down feathers weighing about 180 grams with its opposed surface sheets 14'. A pair of outer fabric sheets 17 encapsulates the thick bed of down feathers 15' by a peripheral stitch seam 18 and thus forming the pouch 12. The thickness of the down feather sheet can vary depending on desired softness or firmness of the pillow pouch.

Figure 5A:
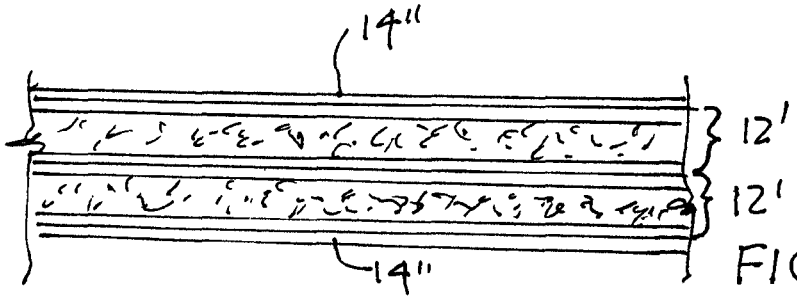
FIG. 5A is a cross-sectional side view showing a stack of two down feather sheets each having an outer fabric sheet used to form a down feather pouch to receive a core body therein.
Figure 5B:
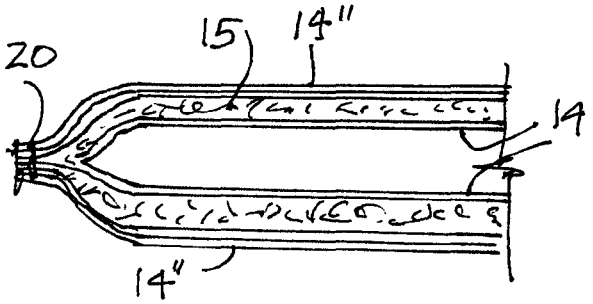
FIG. 5B is a fragmented cross-sectional view illustrating the peripheral stitching of the stack of down feather sheets and pouch outer fabric sheets to form the pouch.
Figure 6:
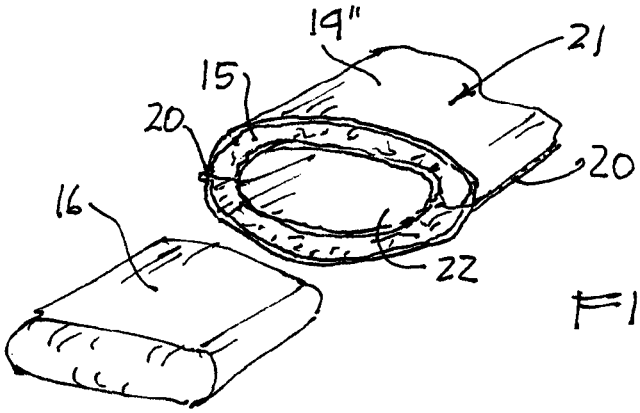
FIG. 6 is a perspective view illustrating a core body being disposed inside the down feather pouch constructed in accordance with FIGS. 5A and 5B.

FIGS. 5A to 6, illustrates a still further embodiment of the constructions of the down-fill pouch wherein the pouch is formed by a pair of down feather sheets 12' cut to form a rectangular down feather sheet and overlaid one on top of the other. On opposed sides of the overlaid down feather sheet is disposed a surface sheet 14" which can be slightly larger or the same size. Because down is highly compressible, by compressing the peripheral edges of the overlaid materials, and forming a peripheral stitch seam 20 there is thus formed a pouch 21 of down feathers for receiving in an unstitched opening 22, the core body 16. Thereafter, the opening 22 is stitched closed.

It is pointed out that the opposed surface sheets 14 or at least one of the sheets 14 may be formed with fibers having heat activating properties whereby to bind to the shaped core and/or the inner surface of the pouch 12 when subjected to heat within a predetermined temperature range. The opposed surface sheets 14 may also be polyurethane aliphatic sheets having stretchable and adhesively binding properties. Still further, the opposed surface sheets may be formed of woven or non-woven fabric material but in all cases these sheets are very thin and light weight. When a peripheral stitch seam is formed, as described above, the down feather mat with its binding agent becomes trapped or encapsulated preventing the egress of down and thereby forming a non-allergic down feather pillow.

Figure 7:
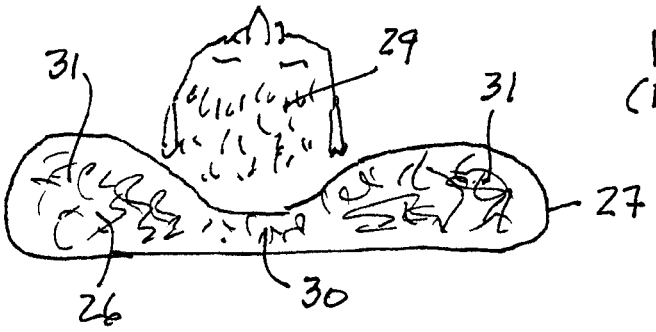
FIG. 7 (PRIOR ART)
FIG. 7 is a perspective illustration of a prior art down feather pillow showing a user's head thereon with the down feathers clumping on opposed sides of the head of the user person.

FIG. 7 illustrates a down-fill pillow 25 formed in accordance with the prior art wherein a down material 26 is loosely disposed inside a pouch 27 which is held captive in a pillow case 28. As shown, when the head 29 of a user person is disposed on such pillow the down is displaced and compressed often offering very little comfort and support in the region 30 of the pillow under the user's head. Because the down material is loose inside the pouch 27 it is free to move within the pouch and usually propagates to the side areas 31 where it does not offer any support and comfort to the user's head 29. This movement of the down is often caused by the user person when manipulating and tapping of the pillow in an attempt to redistribute the down inside the pouch. The down feather sheet 12 has used in the fabrication of a pillow pouch obviates or overcomes this disadvantage of the prior art as illustrated by FIG. 7.

Figure 8:
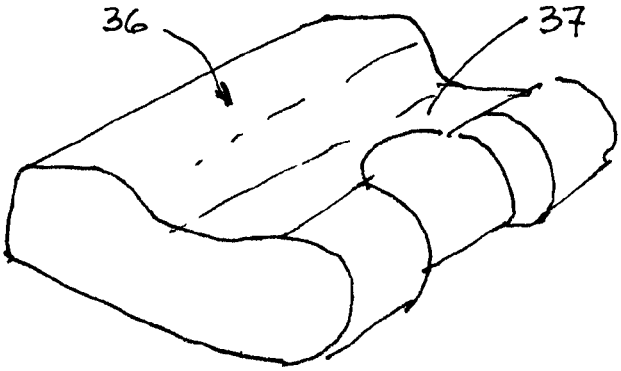
FIG. 8 is a perspective illustration of a therapeutic shaped pillow core formed of rigid foam material.
Figure 9:
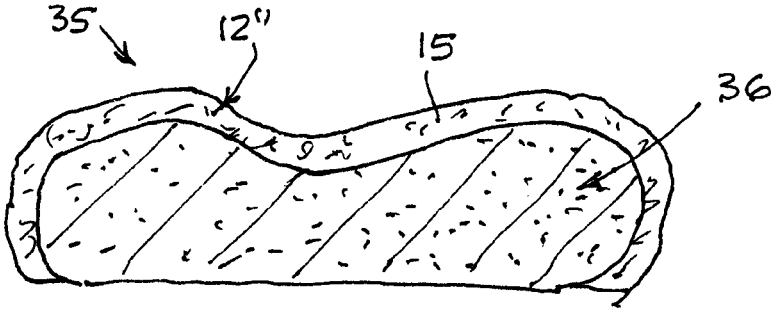
FIG. 9 is a cross-sectional side view of the pillow core of FIG. 8 and on which is adhesively retained down feather sheet sections to provide softness on at least the outer top surface of the therapeutic shaped pillow core.

With reference now to FIGS. 8 and 9, there is illustrated a still further embodiment wherein the down feather sheet 12" is utilized in the construction of an ergonomic pillow 35. As herein illustrated, an ergonomic shaped body 36 is shaped and formed from a urethane foam material or any other similar material having like rigidity to provide therapeutic support to the head and neck of a user person. Such bodies are known in the art but with the present invention there is provided a layer of down-fill material sheet 12" which is adhesively secured to the head support surface portion 37 of the ergonomic shaped body 36 to provide added comfort over a rigid support. Because the down material 15 is held captive it remains in place over the body 36 and restores its shape and constant density when any compression thereof is released.

Although several embodiments of the present invention have been described herein, it is pointed out that other obvious embodiments and modifications are intended to be covered, provided such fall within the scope of the appended claims.

The invention claimed is:

1. A down-fill pillow comprising a fabric pouch in which is captively retained in close fit therein down feather sheets of predetermined density and substantially constant thickness and wherein down feathers are bound together throughout by a binding agent, said down feather sheets having a memory exhibiting rebounding properties, and a shaped core body in said fabric pouch, said down feather sheets being disposed in said pouch to encapsulate said shaped core body, wherein said fabric pouch is formed by a pair of said down feather sheets overlaid one on top of another between opposed elastomeric fabric sheets, a stitch seam about predetermined portions of a periphery of the overlaid pair of down feather sheets and opposed fabric sheets form an opening in said periphery to receive the shaped core body therein.

2. The down-fill pillow as claimed in claim 1 wherein said shaped core body is fabricated of flexible foam material having a shape restoring memory.

3. The down-fill pillow as claimed in claim 1 wherein said shaped core body is fabricated from a high density mixture of down and feathers bound together in a block form by a chemical binding agent.

4. The down-fill pillow as claimed in claim 1 wherein said binding agent is one of a heat activated powder glue or heat activated binding fibers mixed with said down feathers.

5. The down-fill pillow as claimed in claim 2 wherein said predetermined density and thickness is calibrated according to a desired softness or firmness of said down pillow.

6. The down-fill pillow as claimed in claim 2 wherein said shaped core body is formed from a compressible foam material having shape restoring properties and a desired density calibrated according to a desired softness or firmness of said down pillow.

7. The down-fill pillow as claimed in claim 2 wherein said shaped core body is an ergonomic shaped core body constructed of a firm foam urethane material to provide therapeutic support of the head of a user person, said down feather sheet being adhesively retained about at least a head support portion of said ergonomic shaped core body.

8. The down-fill pillow as claimed in claim 2 wherein said down feather sheet is a mat of down feathers sandwiched and bonded between a top and bottom elastomeric sheet.

9. The down-fill pillow as claimed in claim 8 wherein said top and bottom elastomeric sheets have heat activating binding properties whereby to bind to said shaped core body and to an inner face of said pouch when subjected to heat within a predetermined temperature range.

10. The down-fill pillow as claimed in claim 8 wherein said top and bottom elastomeric sheet is formed from an elastic adhesive stretchable fabric.

11. The down-fill pillow as claimed in claim 8 wherein said pouch is fabricated from a non-woven or woven material, said down feathers bound by said binding agent being retained captive between said top and bottom elastomeric sheet, and a peripheral stitched seam about said pouch entrap said down feathers to form a non-allergic down feather pouch.

12. The down-fill pillow as claimed in claim 8 wherein said shaped core body is fabricated from one of, or a combination of, polyurethane, synthetic or natural rubber foams, high-resistant polyurethane, all of selected densities.

13. The down-fill pillow as claimed in claim 1 wherein said pair of down feather sheets are of equal dimension, and the opposed fabric sheets are of like dimension.

14. The down-fill pillow as claimed in claim 13 wherein said shaped core body is a flexible foam core body having a rebounding shape restoring memory.

15. The down-fill pillow as claimed in claim 3 wherein said predetermined density and thickness is calibrated according to a desired softness or firmness of said down pillow.

16. The down-fill pillow as claimed in claim 3 wherein said shaped core body is formed from a compressible foam material having shape restoring properties and a desired density calibrated according to a desired softness or firmness of said down pillow.

17. The down-fill pillow as claimed in claim 3 wherein said shaped core body is an ergonomic shaped core body constructed of a firm foam urethane material to provide therapeutic support of the head of a user person, said down feather sheet being adhesively retained about at least a head support portion of said ergonomic shaped core body.

18. The down-fill pillow as claimed in claim 3 wherein said down feather sheet is a mat of down feathers sandwiched and bonded between a top and bottom elastomeric sheet.

* * * * *